US011751651B2

(12) United States Patent
Johnson

(10) Patent No.: US 11,751,651 B2
(45) **Date of Patent: *Sep. 12, 2023**

(54) CONFIGURABLE BAG

(71) Applicant: Drew Johnson, West Chicago, IL (US)

(72) Inventor: Drew Johnson, West Chicago, IL (US)

( * ) Notice: Subject to any disclaimer, the term of this patent is extended or adjusted under 35 U.S.C. 154(b) by 211 days.

This patent is subject to a terminal disclaimer.

(21) Appl. No.: 17/100,327

(22) Filed: Nov. 20, 2020

(65) Prior Publication Data

US 2021/0068510 A1 Mar. 11, 2021

Related U.S. Application Data

(62) Division of application No. 15/888,046, filed on Feb. 4, 2018, now Pat. No. 10,881,178.

(60) Provisional application No. 62/454,730, filed on Feb. 4, 2017.

(51) Int. Cl.
*A45C 7/00* (2006.01)
*A45C 5/06* (2006.01)
*A45C 3/00* (2006.01)

(52) U.S. Cl.
CPC ..... *A45C 7/009* (2013.01); *A45C 3/00* (2013.01); *A45C 5/06* (2013.01); *A45C 7/0086* (2013.01); *A45C 2003/008* (2013.01)

(58) Field of Classification Search
CPC ..... A45C 7/009; A45C 13/26; A45C 13/28; A45C 13/1969; A45C 7/008; A45C 3/00; A45C 3/06; A45C 7/0086; A45C 2003/008; A45C 5/06
See application file for complete search history.

(56) References Cited

U.S. PATENT DOCUMENTS

| | | | | |
|---|---|---|---|---|
| 2,712,336 | A * | 7/1955 | Casselman | A45C 11/38 383/18 |
| 2,800,940 | A * | 7/1957 | Riesebeck | A45C 13/26 294/154 |
| 10,881,178 | B2 * | 1/2021 | Johnson | A45C 7/0086 |
| 2007/0193902 | A1 * | 8/2007 | Myers | A45C 13/1069 206/320 |
| 2011/0000590 | A1 * | 1/2011 | Welch | A45C 13/002 150/104 |
| 2013/0269844 | A1 * | 10/2013 | Gyuran | A45C 7/009 150/111 |
| 2014/0291329 | A1 * | 10/2014 | Morrow | A45C 3/04 220/495.08 |

* cited by examiner

*Primary Examiner* — Sue A Weaver
(74) *Attorney, Agent, or Firm* — Justin Lampel

(57) ABSTRACT

A configurable bag is provided. The configurable bag has plurality of various interconnecting storage compartments (or "modules"). The interconnecting storage compartments may be selectively used to store various objects such as, for example, shoes, clean clothes, dirty clothes, toiletries, etc. The interconnecting storage compartments may be selectively secured vertically to each other so as to be able to be easily fit within, for example, a standard vertical gym locker. Retractable hooks may be secured to the sides of the interconnecting storage compartments so as to allow the assembled device to hang vertically from a hanger poll. The storage compartments may allow for both front and top access into the interior of the device.

5 Claims, 14 Drawing Sheets

CONFIGURABLE BAG

CROSS-REFERENCE TO RELATED APPLICATIONS

The following application is a divisional application of now issued U.S. Pat. No. 10,881,178.

BACKGROUND OF THE INVENTION

A configurable bag is provided. The configurable bag has plurality of various interconnecting storage compartments (or "modules"). The interconnecting storage compartments may be selectively used to store various objects such as, for example, shoes, clean clothes, dirty clothes, toiletries, etc. The interconnecting storage compartments may be selectively secured vertically to each other so as to be able to be easily fit within, for example, a standard vertical locker. Retractable hooks may be secured to the sides of the interconnecting storage compartments so as to allow the assembled device to hang vertically from a hanger poll. The storage compartments may allow for both front and top access into the interior of the device.

Attempts have been made to provide configurable bags in the past. For example, U.S. Pat. No. 9,055,805 to Koutouras discloses utility a bag having shoulder straps which allows the bag to be used as a backpack to carry clothing, shoes, wet items, personal grooming items, etc. to a gym. At the gym the utility bag can be hung up on one or more of the locker hooks and, when the front panel of the utility bag is opened, all items in the utility bag can be easily accessed without removing the bag from the locker. The bag has a number of separate internally located compartments where each compartment can have a see through mesh front panel which allows a user to see the contents of the compartment and allows air to circulate. The bag has pockets which are accessible from the outside of the bag which allow a user to quickly access a desired item such as a cell phone, wallet, etc. without opening the utility bag.

Further, U.S. Pat. No. 8,651,353 also to Koutouras also discloses a utility bag having shoulder straps which allows the bag to be used as a backpack to carry clothing, shoes, wet items, personal grooming items, etc. to a gym. At the gym the utility bag can be hung up on one or more of the locker hooks and, when the front panel of the utility bag is opened, all items in the utility bag can be easily accessed without removing the bag from the locker. The bag has a number of separate internally located compartments where each compartment can have a see thru mesh front panel which allows a user to see the contents of the compartment and allows air to circulate. The bag has pockets which are accessible from the outside of the bag which allow a user to quickly access a desired item such as a cell phone, wallet, etc. without opening the utility bag.

Still further, U.S. Pat. No. 7,604,102 to Albritton discloses a bag having a back wall having a hook accommodating the hanging of the bag when opened, a plurality of compartments on a front surface of the back wall, the plurality of compartments having a front portion being of a mesh material accommodating a view of the objects and a circulation of air within the compartments. The compartments can have shelves projecting from the back wall to accommodate the objects. The wall can be folded or rolled to close the back wall into the bag for carrying by the handles through hands or on a back of a user. A locking bar on a zipper enclosing the bag can be used to secure the bag to a locker.

However, these devices fail to disclose a configurable bag which is easy to use, quick and inexpensive. Further, these devices fail to provide a configurable bag which easily fits within a locker and keeps clothing and items neatly separated.

SUMMARY OF THE INVENTION

A configurable bag is provided. The configurable bag has plurality of various interconnecting storage compartments (or "modules"). The interconnecting storage compartments may be selectively used to store various objects such as, for example, shoes, clean clothes, dirty clothes, toiletries, etc. The interconnecting storage compartments may be selectively secured vertically to each other so as to be able to be easily fit within, for example, a standard vertical gym locker. Retractable hooks may be secured to the sides of the interconnecting storage compartments so as to allow the assembled device to hang vertically from a hanger poll. The storage compartments may allow for both front and top access into the interior of the device.

An advantage of the present configurable bag is that the present device may be easily configured into different embodiments.

And another advantage of the present configurable bag is that the present device may store shoes and water bottles.

Still another advantage of the present configurable bag is that the present device may have a dual zipper system which allows different compartments to be secured to one another easily and quickly.

Yet another advantage of the present configurable bag is that the present device may allow a user to effectively separate clean clothes from dirty clothes in his/her bag.

Still another advantage of the present configurable bag is that the present device may allow a user to store his/her bag in a vertical orientation.

And another advantage of the present configurable bag is that the present bag allows a user to access the interior of the bag without the need to remove the bag from a locker.

Yet another advantage of the present configurable bag is that the present device may have a mesh layer which allows for proper ventilation.

Another advantage of the present configurable bag is that the present configurable bag may have a rotating hook and a folding hook which allows a user to hang the bag in different orientations.

For a more complete understanding of the above listed features and advantages of the present configurable bag reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

A configurable bag is provided. The configurable bag has plurality of various interconnecting storage compartments (or "modules"). The interconnecting storage compartments may be selectively used to store various objects such as, for example, shoes, clean clothes, dirty clothes, toiletries, etc. The interconnecting storage compartments may be selectively secured vertically to each other so as to be able to be easily fit within, for example, a standard vertical locker. Retractable hooks may be secured to the sides of the interconnecting storage compartments so as to allow the assembled device to hang vertically from a hanger poll. The storage compartments may allow for both front and top access into the interior of the device.

Figure 1:
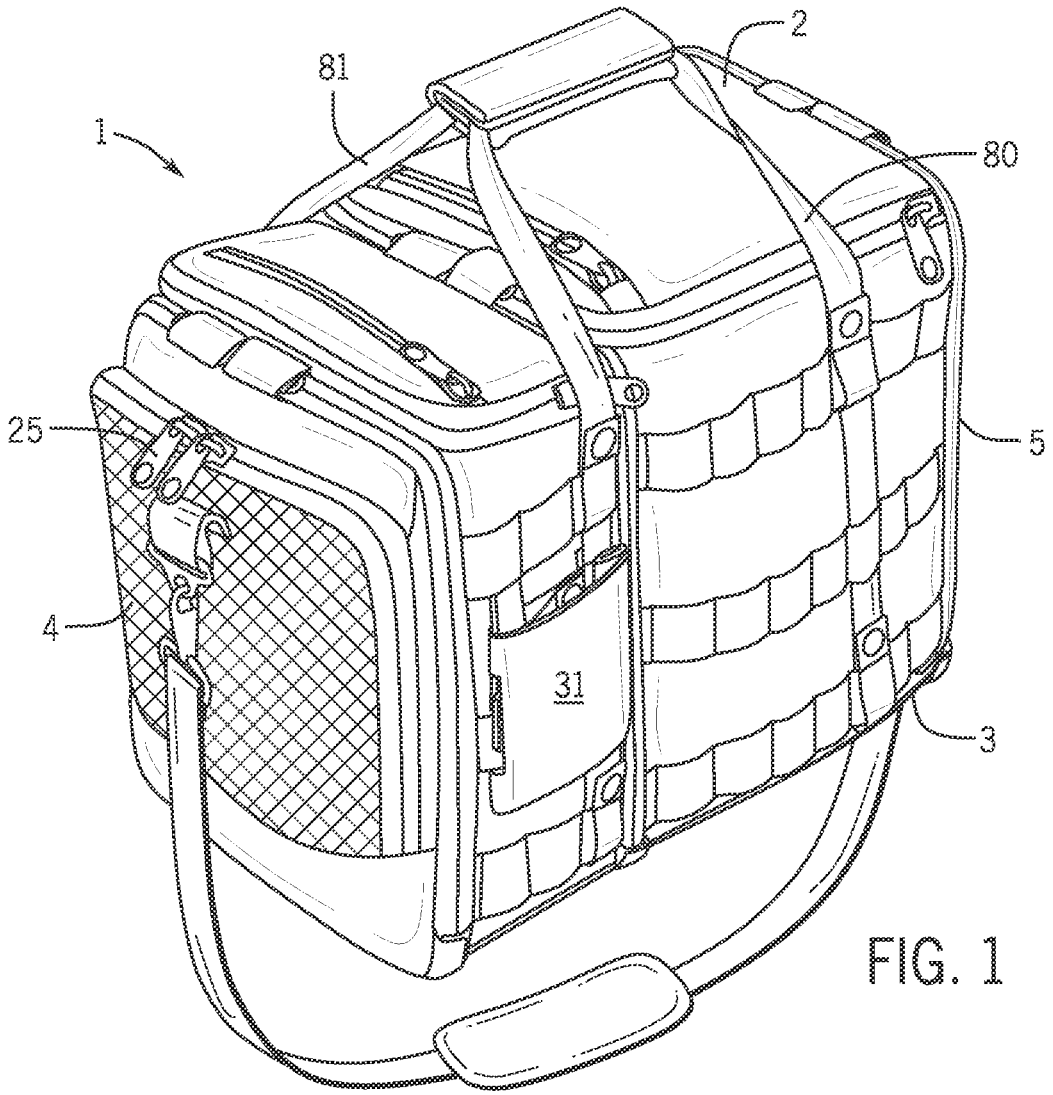
FIG. 1 illustrates a perspective view of the configurable bag in one fully assembled embodiment.
Figure 2:
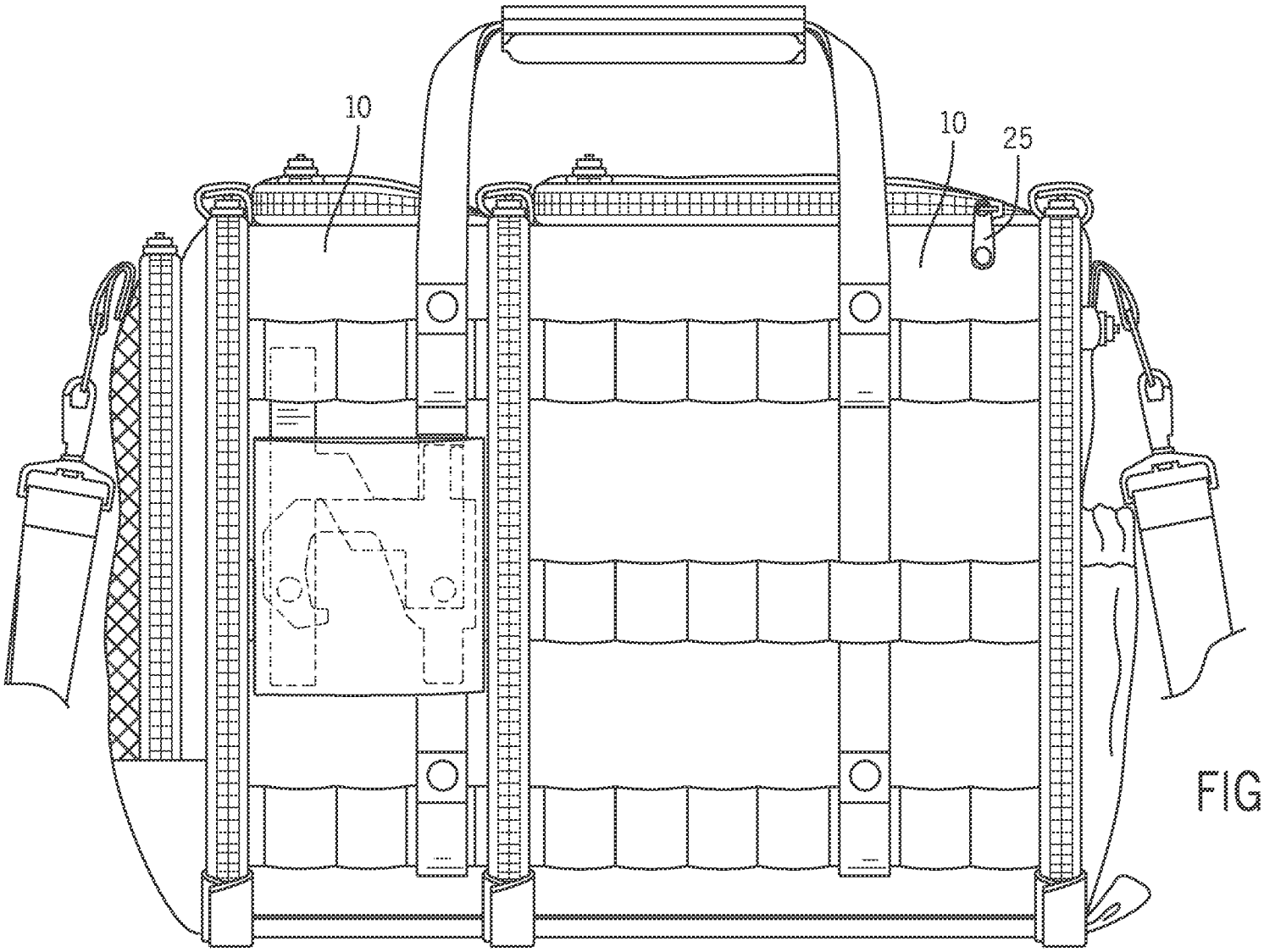
FIG. 2 illustrates a side view of the configurable bag.
Figure 4:
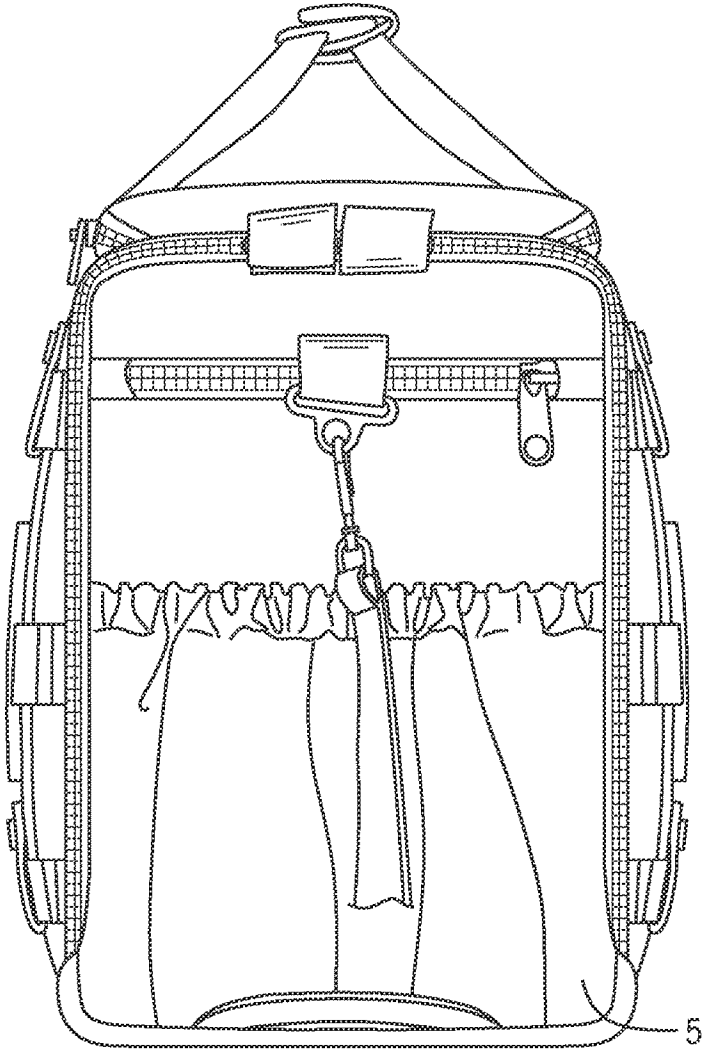
FIG. 4 illustrates a back view of the configurable bag.
Figure 3:
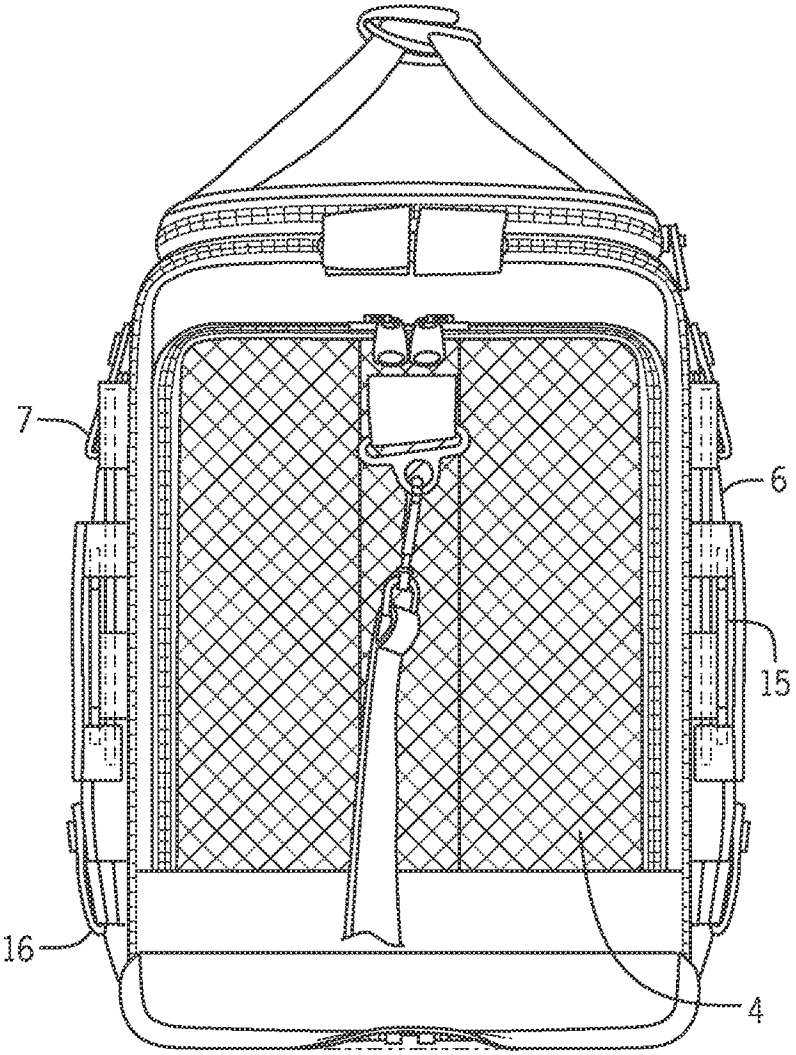
FIG. 3 illustrates a front view of the configurable bag.
Figure 5:
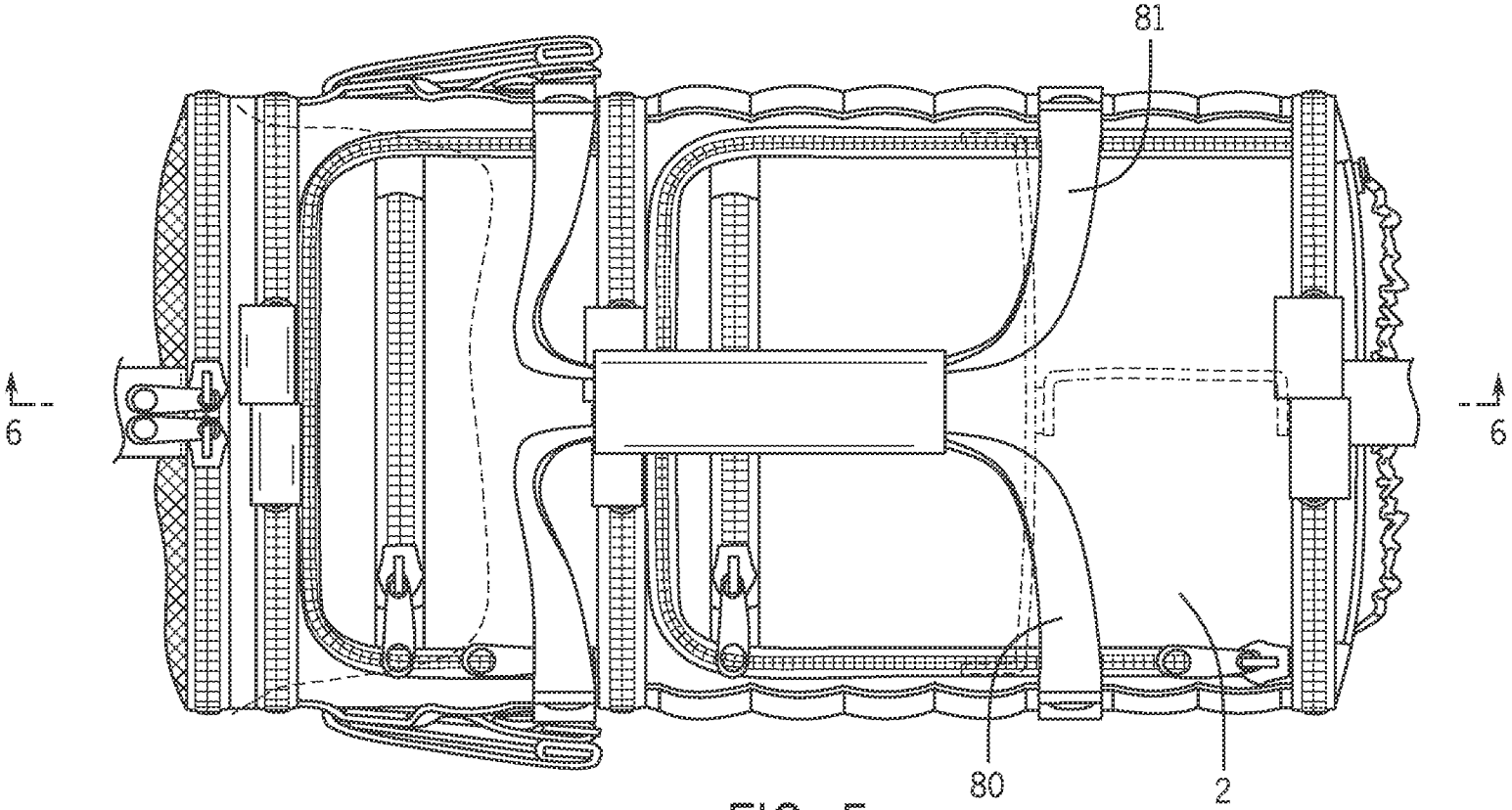
FIG. 5 illustrates a top view of the configurable bag.
Figure 6:
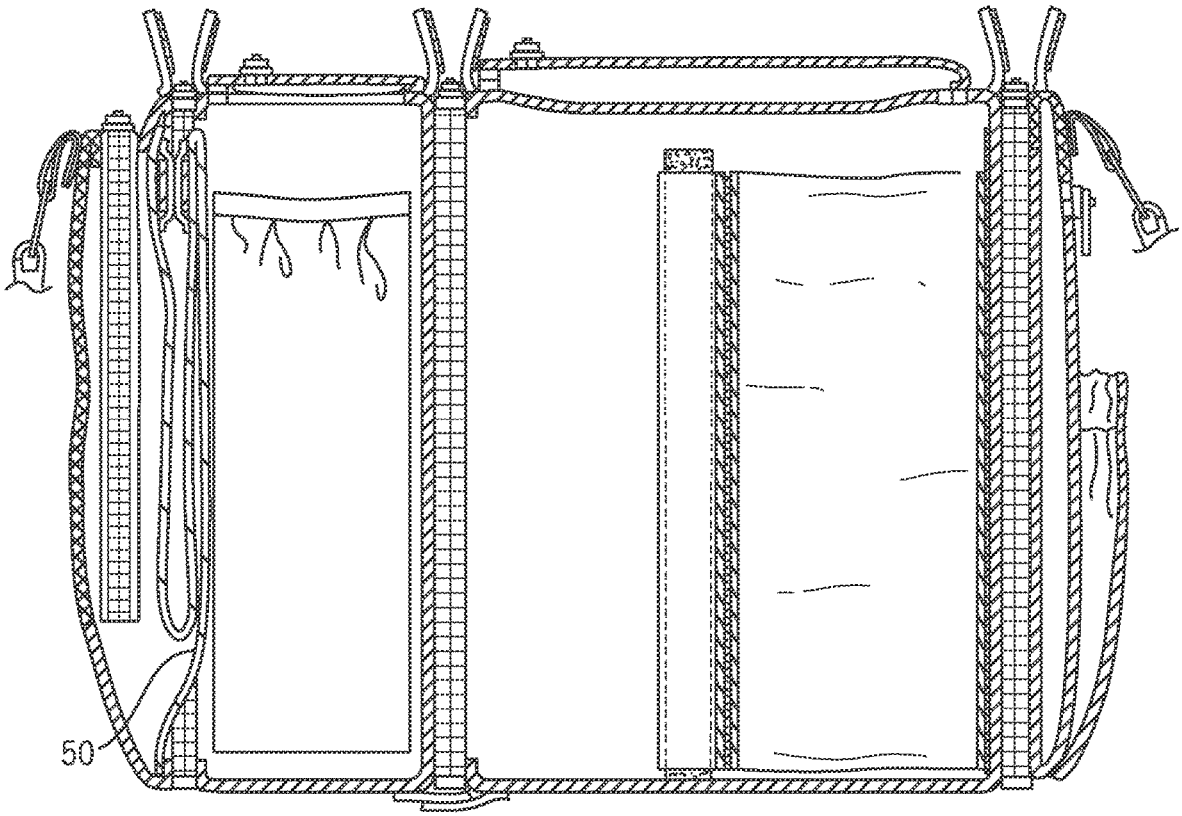
FIG. 6 illustrates a cross sectional view of the side of the configurable showing the interior of the bag.
Figure 7:
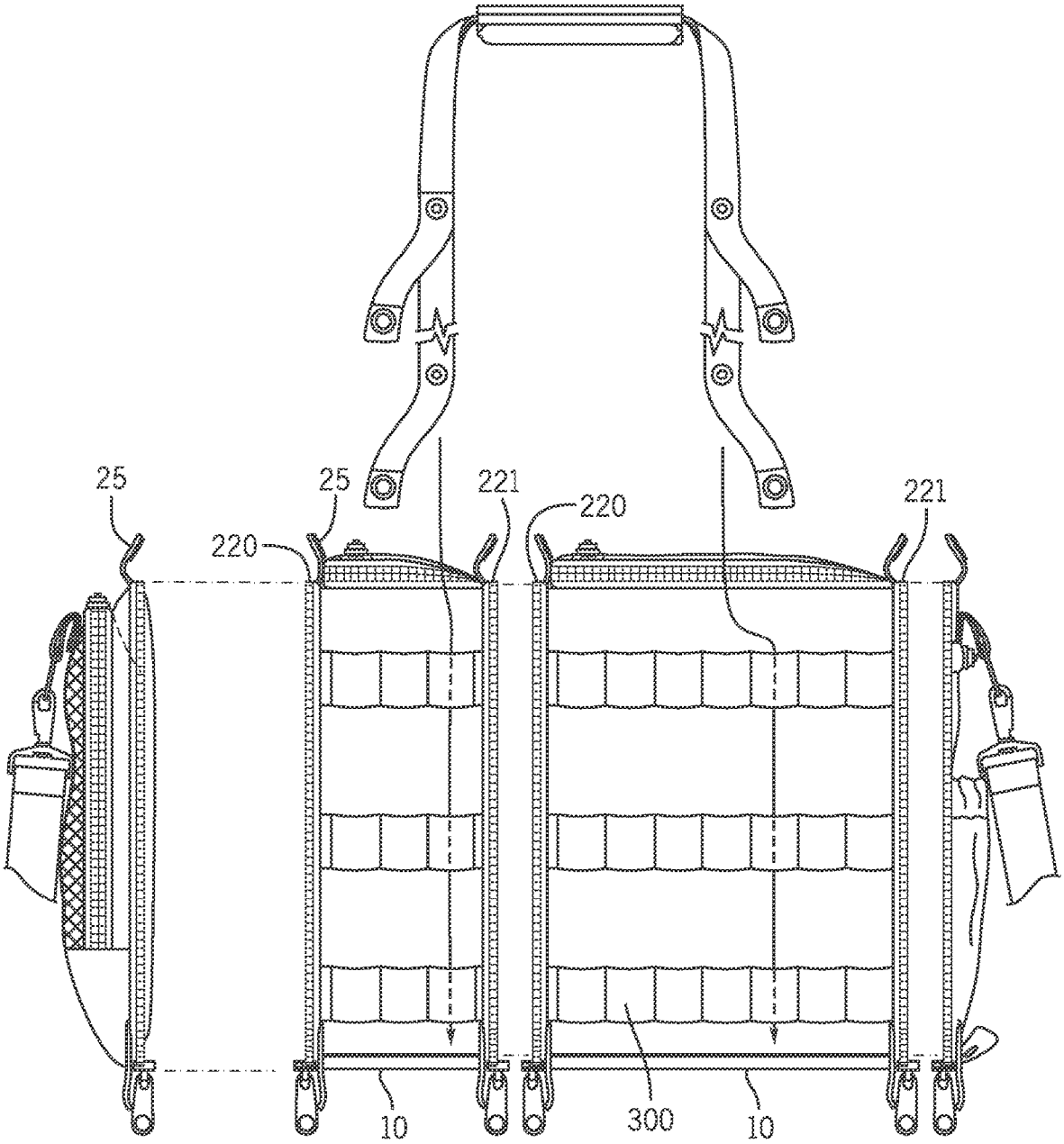
FIG. 7 illustrates a side view of the configurable bag wherein the handles are illustrated in the process of being secured to the bag.

Referring now to the drawings, FIG. 1 illustrates a configurable bag 1 in a fully assembled embodiment. In its fully assembled embodiment, the configurable bag 1 may have a top 2, a bottom 3, a front 4, a back 5, a first side 6 and a second side 7 (FIG. 3). The fully assembled configurable bag 1 may be made of a plurality of various individual compartments (or "modules") 10. FIG. 2 illustrates two separate individual configurable compartments 10 utilized in one embodiment. In an embodiment, each compartment 10 may have a generally hollow interior 100 (FIG. 8) for storing personal items such as, for example, clothes 88 or the like. When the individual compartments 10 of FIG. 7 are secured to one another, they become the full functional embodiment of FIG. 1. It should understood that a user may select the number of compartments 10 to use and the type of compartments 10 to be used in creation of the fully assembled embodiment configurable bag 1. More specifically, a user may select to secure only two compartments 10 together if the user does not need much storage for a specific trip (for example to so the gym) or a user may utilize five, six or even more individual compartments 10 if necessary (not shown). In an embodiment, the compartments 10 may be sold separately and each compartment 10 may have a various different specialized use (for example, the compartments 10 of FIG. 7 are of different sizes). In one embodiment, at least one compartment 10 is made of a mesh material for allowing ventilation of items held by the bag 1 and the compartments are preferably bendable and durable.

Figure 8:
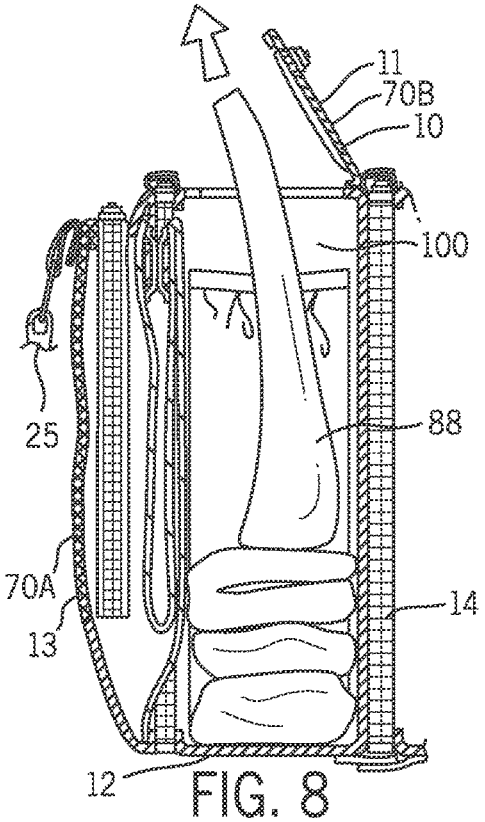
FIG. 8 illustrates a cross sectional view of the side of an end of the configurable bag wherein the hamper portion is illustrated and wherein an article of clothing is inserted or removed through the top of the device.
Figure 9:
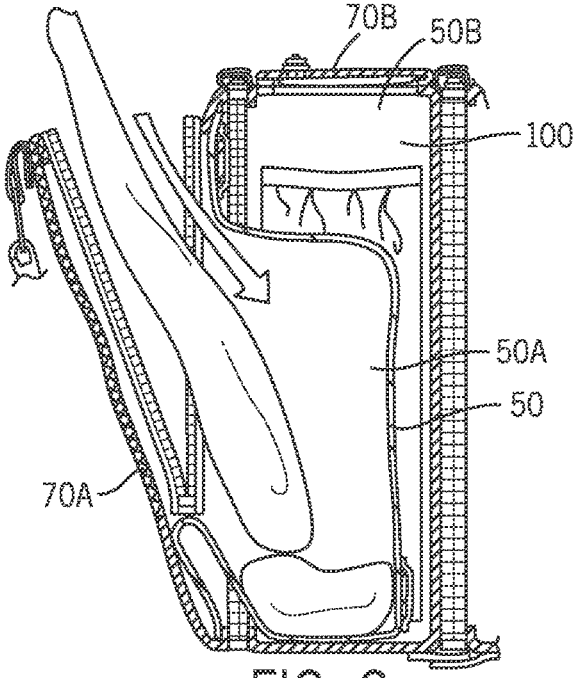
FIG. 9 illustrates a cross sectional view of the side of the end of the configurable bag showing an article of clothing being inserted into the hamper portion of the bag at the front of the device.
Figure 21:
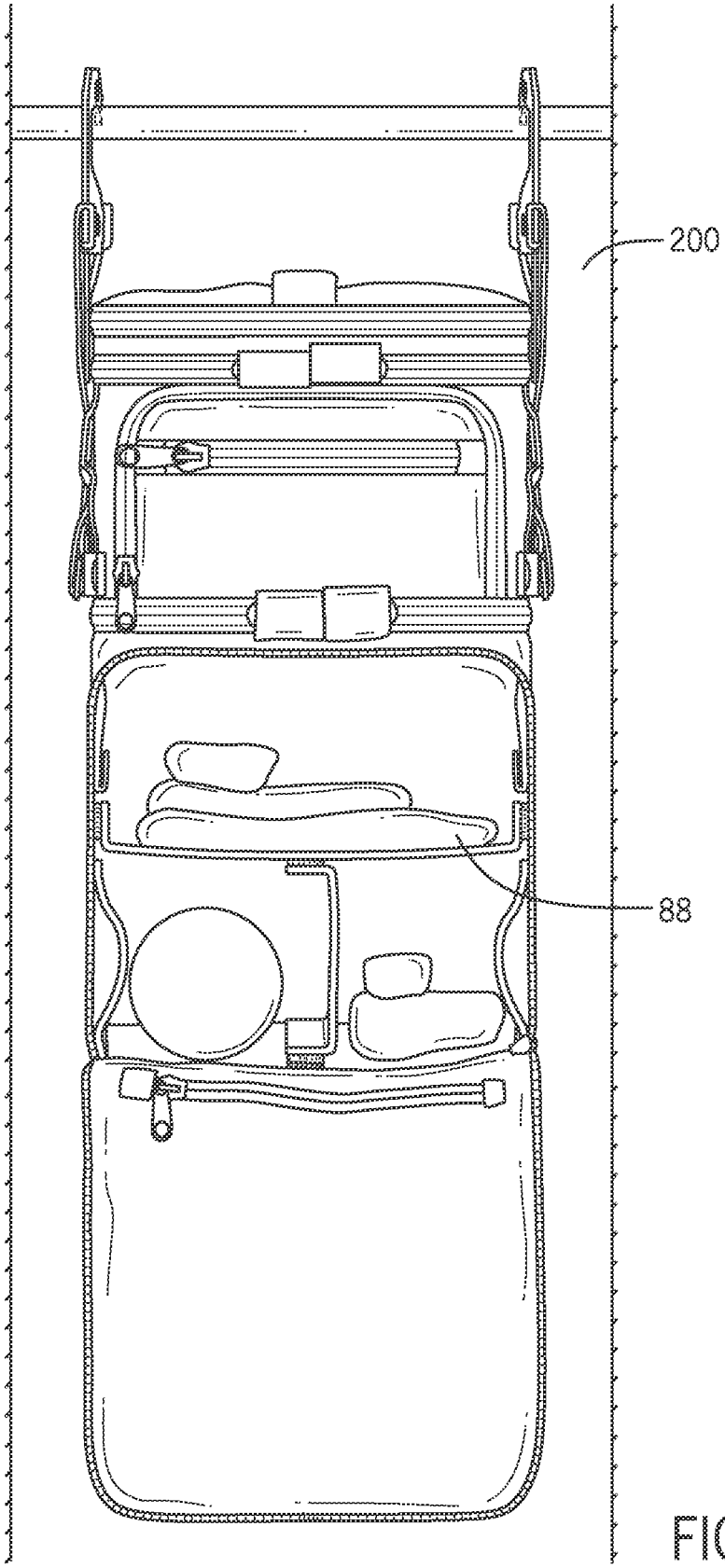
FIG. 21 illustrates a view of the configurable bag hanging from a locker in an orientation.

Referring now to FIGS. 8 and 9, in an embodiment, the individual compartments 10 may each have a top 11, a bottom 12, a front 13, a back 14, a first side 15 and a second side 16 (FIG. 3). In an embodiment, the front 13 and/or the top 11 of the compartments 10 may be/have movable panels which allow a user to access the interior 100 of the compartments 10 and, in an embodiment, to expand the size of the interior 100 of the compartments 10 due to the bendable and folding nature of the movable panels. A securing mechanism 25 (for example, a zipper or "clasp lock") may run along an edge of, for example, the front 13 and/or the top 11 of the compartments 10 so that a user may open the compartment 10 at various locations. In particular, the present configurable bag 1 may therein allow a user to access the interior 100 of the bag 1 through the front 13 and/or top 11 of the bag 1 without the need to remove the bag 1 from a locker 200 (FIG. 21).

Figure 10:
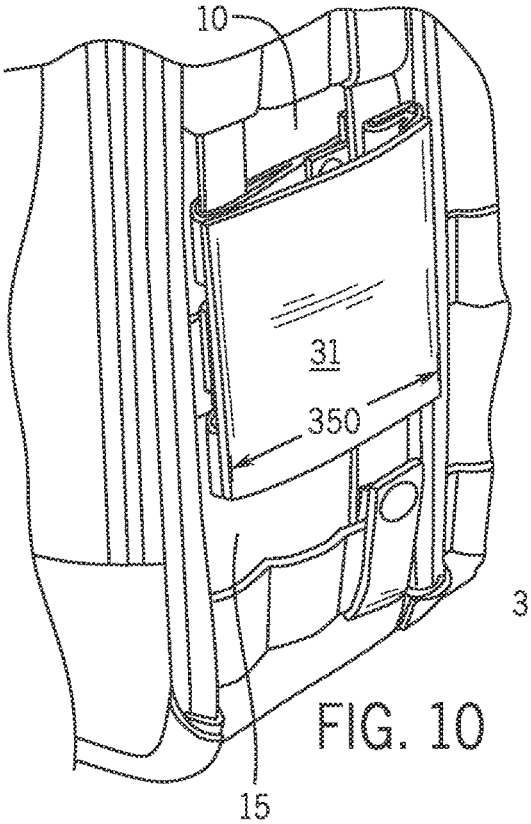
FIG. 10 illustrates a perspective view of the folding hook of the configurable bag wherein the folding hook is in the first orientation.

Referring now to FIGS. 10-13, in an embodiment, at least one of the compartments 10 may have a folding hook 30 attached. In particular, the folding hook 30 may be partially secured within a bendable pocket 31 (or 'surface') located on, for example, the first side 15 and/or the second side 16 of the compartment 10. Preferably, the bendable pocket 31 is made of cloth or some other suitable bendable and durable material whereas the hook 30 is preferable made of a durable material such as metal which can support the weight of the bag 1 and its contents. In an embodiment, the bendable pocket 31 may have a first end 32, a second end 33, and a securing element 34 wherein the securing element 34 secures the folding hook 30 to the bendable pocket 31. The bendable pocket 31 may further have a length 350 which is slightly larger than a length 360 (FIG. 14) of the folding hook 30 so that the pocket 31 may completely cover the folding hook 30 in one orientation (FIG. 10).

The folding hook 30 may move with respect to the bendable pocket 31 and the bendable pocket 31 may further move with respect to the side 15 of the configurable bag 1. FIG. 10 illustrates the first orientation wherein the folding hook 30 is folded under the pocket 31 such that the folding hook 30 is barely visible or completely obscured by the bendable pocket 31. In this first orientation, a first set of magnet(s) 36 of the folding hook 30 may be attracted to a second set of magnet(s) 37 located on a (preferably) metal brace 55 (FIG. 14) which is located on the side 15 of (or actually within the side 15 of) of the configurable bag 1. As a result, when the folding hook 30 and the bendable pocket 31 are in the first orientation of FIG. 10, the bendable pocket 31 secures the folding hook 30 in a flush manner against the side 15 of the bag 1. In this orientation, the folding hook 30 is not used to hang the bag 1. When the matching of the set of magnets 36 of the folding hook 30 align with the set of magnets 37 of the brace 55 in the first orientation, the folding hook 30 is then properly aligned to the side 15 of the bag 1 and does not inadvertently move.

Figure 12:
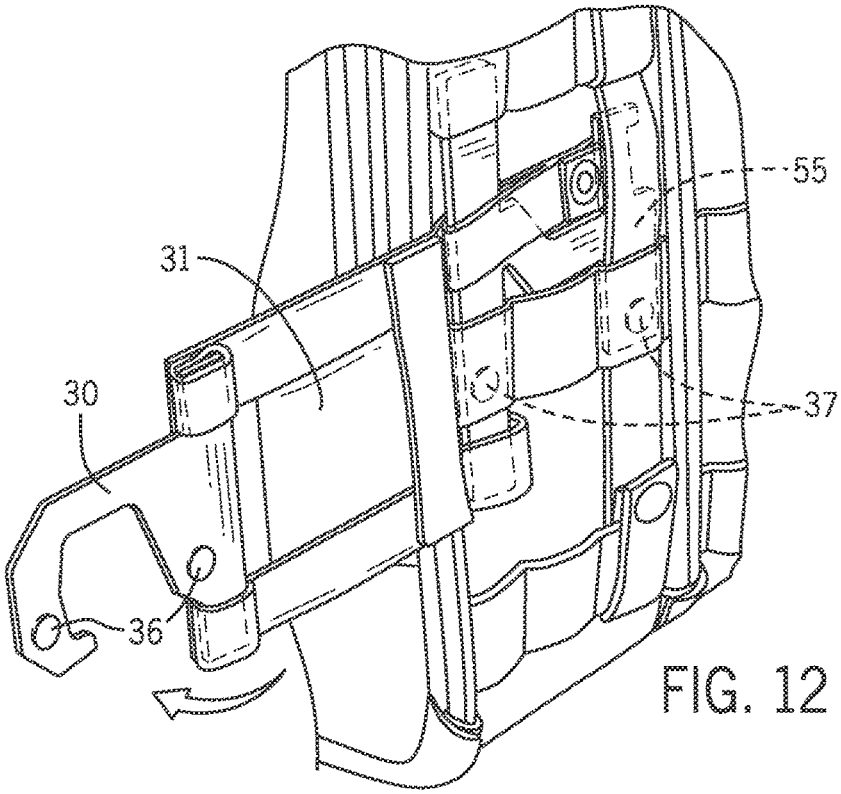
FIG. 12 illustrates a perspective view of the folding hook of the configurable bag wherein the folding hook is in a usable third orientation.

If a user wishes to utilize the folding hook 30 to, for example, hang the bag 1 from a locker 200 (FIG. 21) the user may elect to pull the bendable pocket 31 and folding hook 30 away from the magnet 37 of the brace 55 of the side 15 of the bag 1 (the brace 55 always remains flush with the side 15 of the bag 1). In utilizing the folding hook 30 a user may select a short extension orientation (FIG. 13) or a long extension orientation (FIG. 12). In particular, if a user wishes to hang the bag 1 close to the top of a locker 200, a user may elect the short extension orientation of FIG. 13.

Figure 11:
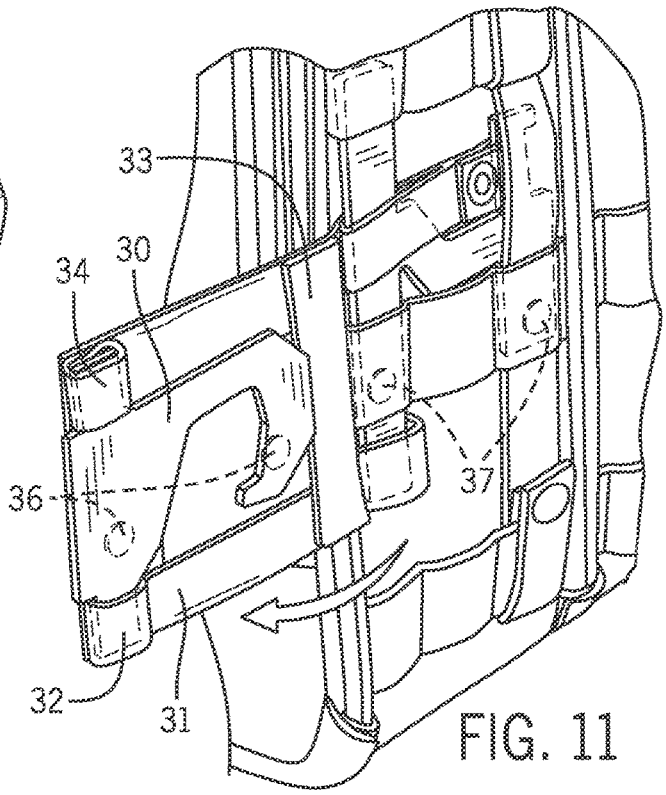
FIG. 11 illustrates a perspective view of the folding hook of the configurable bag wherein the folding hook is in the second orientation.

In the short extension orientation, in one embodiment of use, a user first together pulls the bendable pocket 31 and folding hook 30 away from the second magnet 37 of the brace 55 and then bends the bendable pocket 31 so that the folding hook 30 passes through an opening 40 (FIG. 13) between the bendable pocket 31 and the bag 1. In this orientation, the bigger end 49 of the folding hook 30 is located right next to the bag 1 and the bendable pocket 31 essentially takes the shape of a cylinder. However, if the longer extension orientation is desired, a user simply rotates the foldable hook 30 and the bendable pocket 31 away from the second set of magnets 37 of the brace 55 of the side 15 of the bag 1 (as shown in FIG. 11) and then further unfolds the folding hook 30 a second time from the bendable pocket 31 as is shown in FIG. 12. In this FIG. 12 orientation, the folding hook 30 is more distally located from the bag 1 and will hang in a locker 200 further down.

Figure 13:
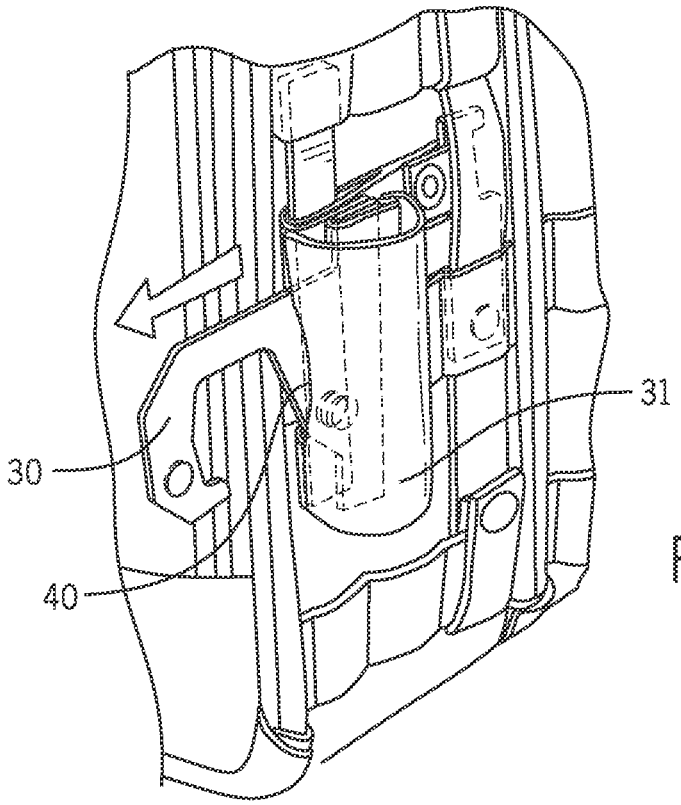
FIG. 13 illustrates a perspective view of the folding hook of the configurable bag wherein the folding hook is in a usable fourth orientation.
Figure 14:
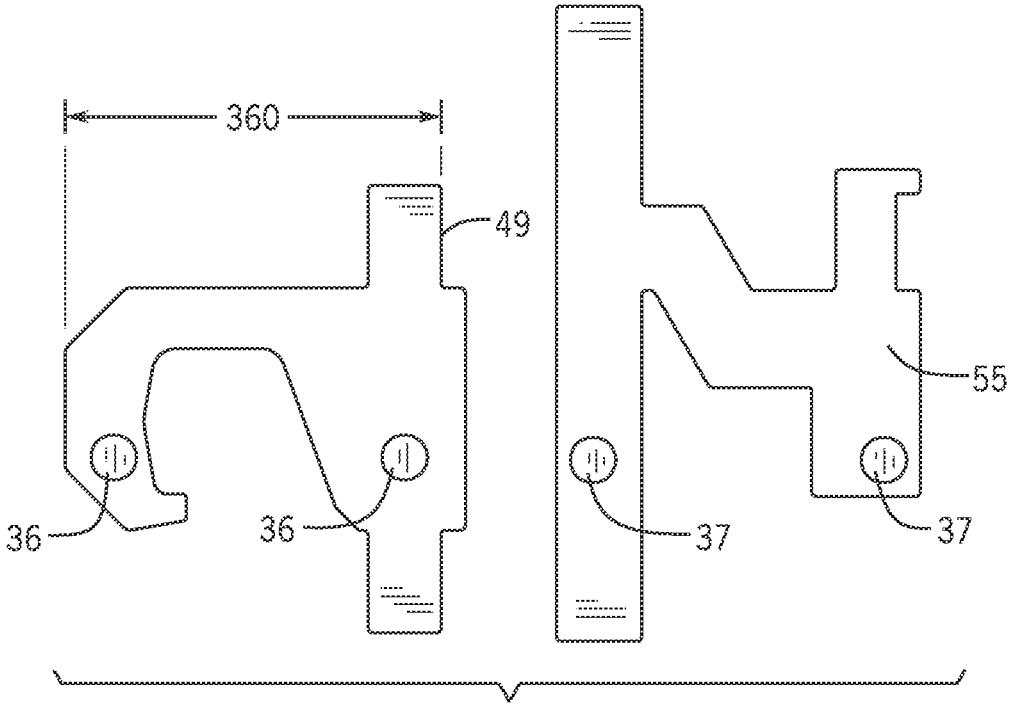
FIG. 14 illustrates the folding hook and the corresponding metal brace of the configurable bag.

A second method of utilizing or getting to the short extension orientation of FIG. 13 is achieved by a user merely pushing the bigger end 49 of the folding hook 30 forward toward the front of the bag 1 (while keeping the folding hook 30 generally parallel and generally flush with the side 15 of the bag 1). More specifically, the folding hook 30 slides through the opening 40 between the bendable pocket 31 and the bag 1 while the folding hook 30 is still parallel with the side of the bag 1. This causes the bendable pocket 31 to bend. When pushed forward, at least one magnet 36 of the folding hook 30 remains aligned with and attracted to at least one magnet 37 of the brace 55. Thus, the magnets 36, 37 align and keep the folding hook 30 in place in either the first orientation (FIG. 10) or the short orientation (FIG. 13).

Referring now to FIG. 9, in an embodiment, the interior 100 of the compartments 10 may have a flexible lining 50 in certain versions of the configurable bag 1 wherein the flexible lining 50 may further divide the interior 100 of a compartment 10. The linings may form a 'hamper' within the interior 100 of the bag 1. In those embodiments, the lining 50 may be waterproof so as to prevent liquids from spilling from one compartment 10 to another compartment 10 or within the same compartment 10 (as is shown in FIG. 9). This is especially suitable when wet swimsuits are placed in the compartment 10 with dry clothes 88. In embodiments with the lining 50, a user may, for example, access a first hamper compartment 50A (FIG. 9) if the user utilizes the front movable panel 70A or may access a second hamper compartment 50B if a user utilizes a top movable panel 70B wherein both hamper compartments 50A, 50B are located in the same removable compartment 10 of the configurable bag 1. Further, in the embodiment with the lining 50, the two hamper compartments 50A and 50B may completely separate items such as clothing 88 from each other. In an embodiment, the flexible liner 50 is water impenetrable.

Figure 15:
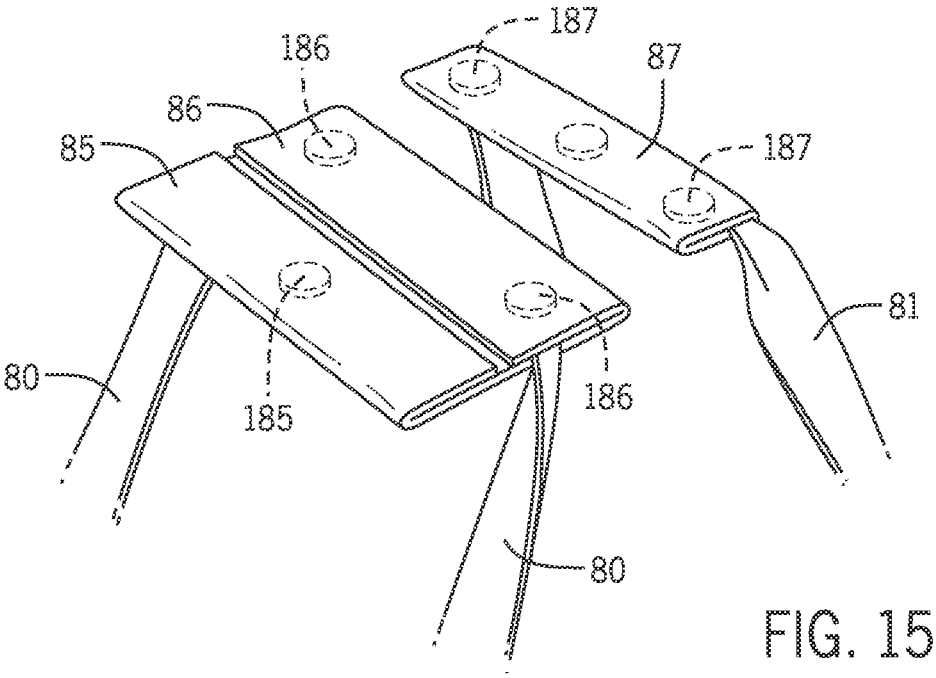
FIG. 15 illustrates a perspective view of the handle of the configurable bag wherein the handle is in the first orientation.
Figure 16:
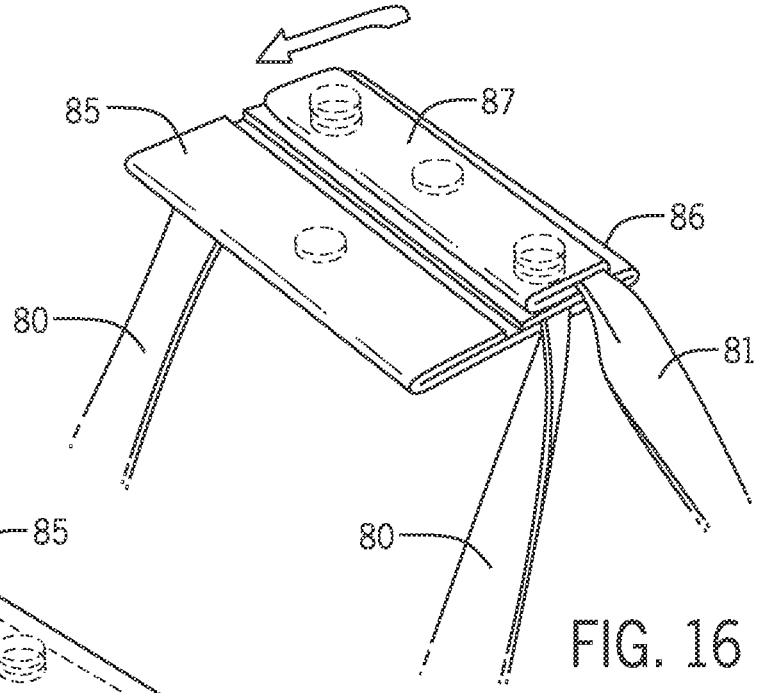
FIG. 16 illustrates a perspective view of the handle of the configurable bag wherein the handle is in the second orientation.
Figure 17:
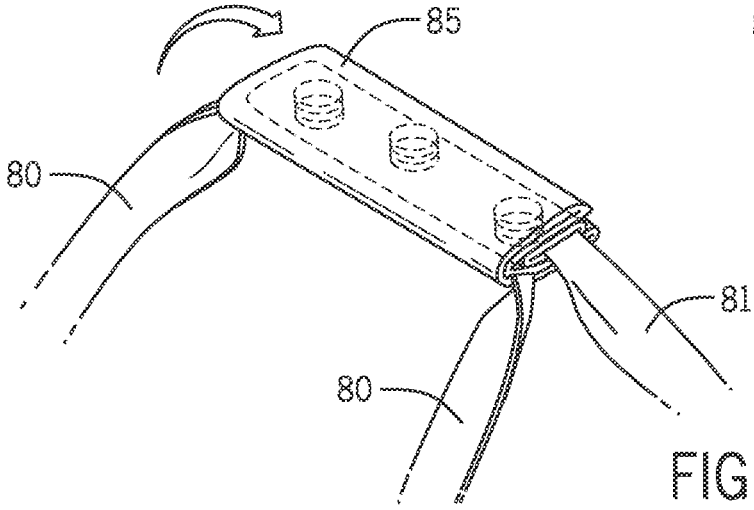
FIG. 17 illustrates a perspective view of the handle of the configurable bag wherein the handle is in the third orientation.

Referring now to FIGS. 15 to 17, in an embodiment, the configurable bag 1 may have a first strap 80 and a second strap 81 wherein the first strap 80, the second strap 81 or both straps secured together (as shown in FIG. 17) may be used to, for example, carry the configurable bag 1. The first strap 80 may have a first unit 85 and a second unit 86 whereas the second strap 81 may only have a first unit 87. A magnet 185 may be located on or in the first unit 85 of the first strap 80 and a plurality of magnets 186 may be located in the second unit 86 of the first strap 80. A plurality of magnets 187 may be further located in the first unit 87 of the second strap 81. If a user wishes to secure the first strap 80 to the second strap 81 so that the two straps meet and allow for easy carrying of the bag 1 the user first places the first unit 87 of the second strap 81 over the second unit 86 of the first strap 80. In this position (as illustrated in FIG. 16) the magnets 186, 187 align and secure the straps 80, 81 together. The first unit 85 of the first strap 80 may then be folded over the first unit 87 of the second strap 81 for better security (as illustrated in FIG. 17). The magnets 185, 186 and 187 may temporarily and removably secure the straps 80, 81 together so a user may easily carry the bag 1.

Figure 18:
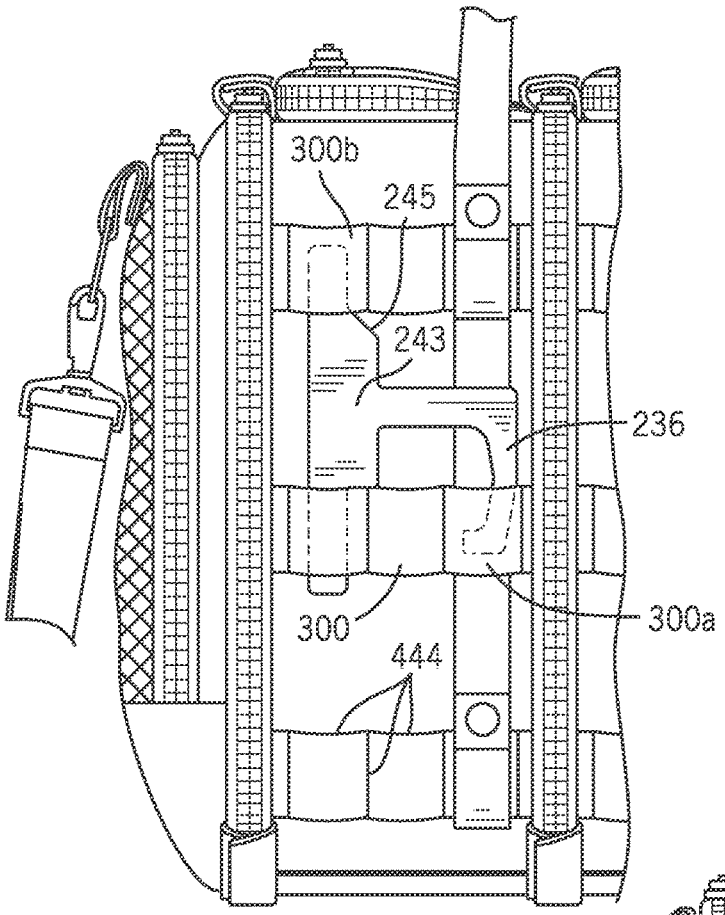
FIG. 18 illustrates a perspective view of the rotating hook of the configurable bag wherein the rotating hook is in the first orientation.
Figure 19A:
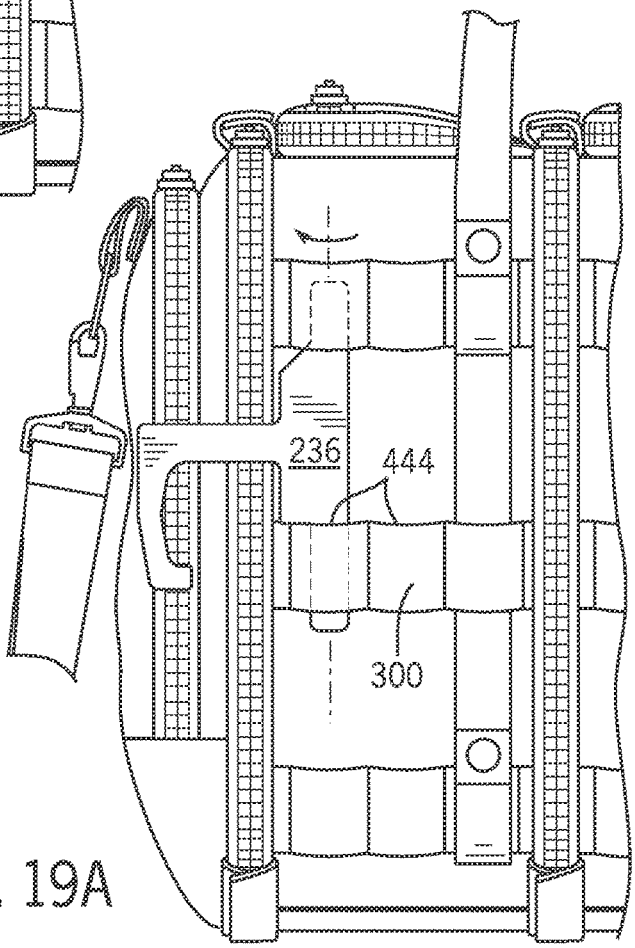
FIG. 19A illustrates a perspective view of the rotating hook of the configurable bag wherein the rotating hook is in the second orientation.
Figure 19B:
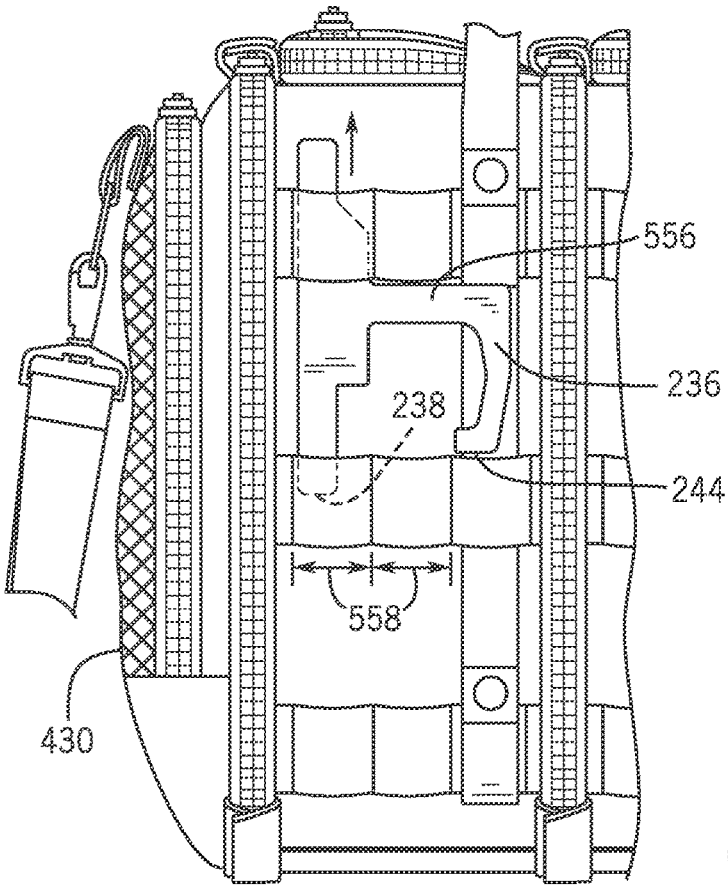
FIG. 19B illustrates the rotating hook of the configurable bag wherein the rotating hook is in the upward orientation.
Figure 20:
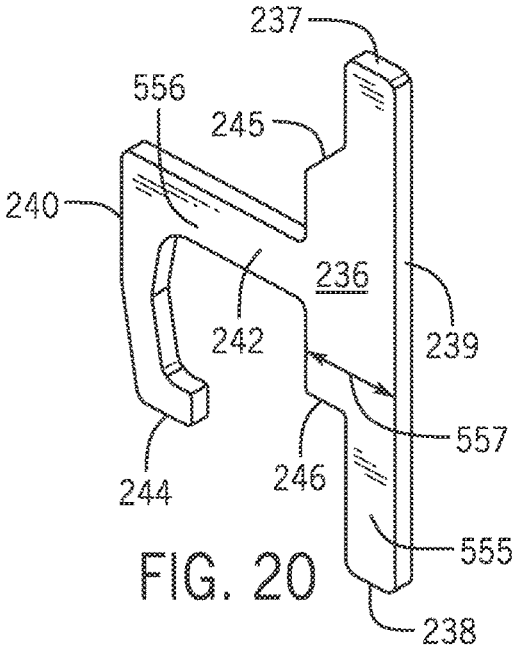
FIG. 20 illustrates a view of the rotating hook of the configurable bag wherein the rotating hook is not attached to the body of the configurable bag.
Figure 19C:
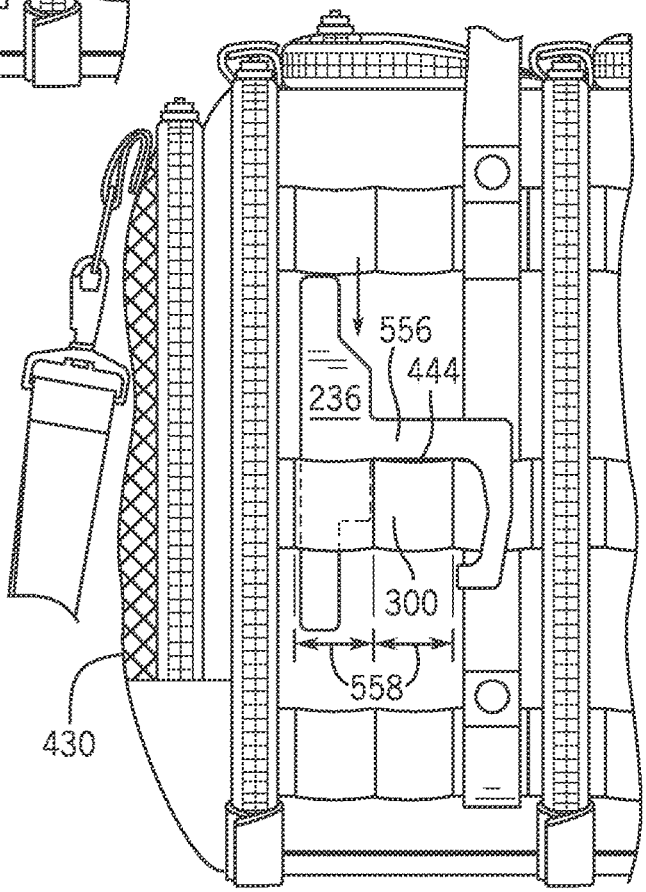
FIG. 19C illustrates the rotating hook of the configurable bag prior to removal of the rotating hook from the bag.

Referring now to FIGS. 18 to 20, in an embodiment, the bag 1 may have a rotating hook 236 which may have a top 237, a bottom 238, a first end 239, a second end 240, a first side 242, a second side 243, an arm portion 556 and a tip 244 extending off the arm portion 556. Toward the top 237 of the rotating hook 236 may be a beveled edge 245 and toward the bottom 238 of the rotating hook 236 may be an extended ridge (or 'tang') 246. In one embodiment, the beveled edge 245 has an angle between forty and fifty degrees and is on the opposing side of the arm portion 556 than the extended ridge 246. The rotating hook 236 preferably is generally flat and made of a durable material, such as a metal. The rotating hook 236 may move horizontally from a first orientation (FIG. 18) to a second orientation (FIG. 19A) and may additionally move vertically from a first middle orientation (FIG. 18) to a second upward orientation (FIG. 19B) and even a downward orientation (FIG. 19C).

The rotating hook 236 may have a "main bar" section 555. The main bar section 555 is essentially the longest portion of the rotating hook 236, as illustrated vertically from the top 237 to the bottom 238 on the far right side of the rotating hook 236 of FIG. 20. The length of the main bar section 555 is greater than the distance between the plurality of pouches 300 in the top row and the plurality of pouches 300 on the bottom row (As shown in FIG. 19B) so that the rotating hook 236 may have a portion secured in both the upper pouches 300 and the lower pouches 300 at the same time. In an embodiment, the rotating hook 236 may be permanently removed from being attached to the configurable bag 1 while the folding hook 30 may not be permanently removed from the configurable bag 1.

The extended ridge 246 and a portion of main bar 555 thus have a combined width 557. This width 557 (FIG. 20) of the portion of the rotating hook 236 may be slightly smaller than a width 558 (FIG. 19B) of each of a plurality of securing pouches 300. As a result, the extended ridge 246 of the rotating hook 236 may be snuggly inserted into a securing pouch 300 up to the arm 556 (FIG. 19C) of the rotating hook 236. When in the configuration of FIG. 19C and the extended ridge 246 is snuggly within a securing pocket 300, the top 237 of the rotating hook 236 may then be completely free from all securing pouches 300 and only then may the rotating hook 236 may then be completely removed from the bag 1 (and generally only when the rotating hook 236 is not bearing weight). As illustrated in FIG. 19A, the plurality of pouches 300 may each have an opening end on both the top and bottom of the pouches 300 so that the a portion of the rotating hook 236 may completely pass through the pouches 300. Although the exact percentage may vary, preferably the width 557 of the portion of the rotating hook 236 is approximately eighty-five to ninety-eight percent the width 558 of each of the plurality of securing pouches 300.

Because the extended ridge 246 barely fits within the securing pouch 300, the extended ridge 246 is generally prevented from unintentionally falling into the securing pouch 300. The distance between the extended ridge 246 and the tip 244 of the rotating hook 236 is less than the width 558 of each of the individual pouches 300. Therefore, it is impossible for the width 557 (described above) to align with one of the individual pouches 300 when the rotating hook 236 is stowed away as shown in FIG. 18. When in this position, due to the lesser distance between the end of the ridge 246 and the tip 244 compared to the width 558 of one of the individual pouches 300, the tip 244 of rotating hook 236 positions the main bar 555 towards the right side (when viewing as in FIG. 18) of both individual pouches 300 it's engaging. As a result, the extended ridge 246 is unable to move further downward as it is contacting stitching 444 and therefore prevents the tip 244 from entirely passing through one of the individual pouches 300. The distance between the tip 244 and the main bar 555 is barely larger than the width 558 of the individual pouches 300, so that the tight fit (along with gravity when sitting horizontally as shown in FIG. 1 or being carried horizontally) prevents the rotating hook 236 from unintentionally moving or becoming dislodged from the position shown in FIG. 18.

In an embodiment, the top 237 and the bottom 238 of the rotating hook 236 may each be secured within a separate of a plurality of securing pouches 300 which run substantially along the entire sides 15, 16 of the configurable bag 1. As stated above, the rotating hook 236 may move vertically from the first middle orientation (FIG. 18) to the second upward orientation (FIG. 19B) so that the tip 244 (which may be secured in one of the securing pouches 300A in the first orientation) may then be removed from the securing pouch 300A. To remove the tip 244 from the securing pouch 300A, a user slightly shifts the rotating hook 236 upward (toward the top 2 of the bag 1). The beveled edge 245 allows the rotating hook 236 to slightly expand the securing pouch 300B so that the tip 244 may be removed from the securing pouch 300A holding the same. In particular, when the beveled edge 245 is partially or completely be pushed into the pocket 300B, the arm 556 of the rotating hook 236 may contact the stitching 444 of the securing compartments (or "webbing") 300 directly above the arm 556 of the rotating hook 236 and may prevent further upward movement of the rotating hook 236 and may prevent the bottom 238 of the rotating hook 236, but not the tip 244 of the rotating hook 236, from becoming dislodged from the securing pouches 300. This is illustrated in FIG. 19B.

The extended ridge 246 toward the bottom 238 of rotating hook 236 prevents the rotating hook 236 from being moved downward, while it may be slightly be moved upward. Once the tip 244 is removed from the securing pouch 300A, the rotating hook 236 may then be rotated horizontally to the second orientation (FIG. 19A).

In an embodiment, the extended ridge (or 'tang') 246 may be aligned so as to partially or completely pass through one of the securing pouch 300 (or 'webbing') until the arm 556 of the rotating hook 236 contacts the stitching 444 of the securing pouch 300 and stops further downward movement of the rotating hook 236. In this orientation, the top end 237 may be free from the securing pouch 300 and the entire rotating hook 236 may be removed from the configurable bag 1. Because the extended ridge (or 'tang') 246 is so close to the stitching 444 of the securing pouch 300 (such as in FIG. 19A) the extended ridge 246 of the rotating hook 236 does not naturally want to slide through a securing pouch 300 the way the beveled edge 245 easily can slide through one of the securing pouches 300. Instead, the rotating hook 236 may only be completely removed from the bag 1 once the tip 244 is removed from its corresponding securing pouch 300A and the rotating hook 236 is substantially flat against the side 6, 7 of the bag 1. It should be noted that the rotating hook 236 may be completely removed from the bag 1 and reattached in virtually any securing pouches 300 of the bag 1.

Figure 22:
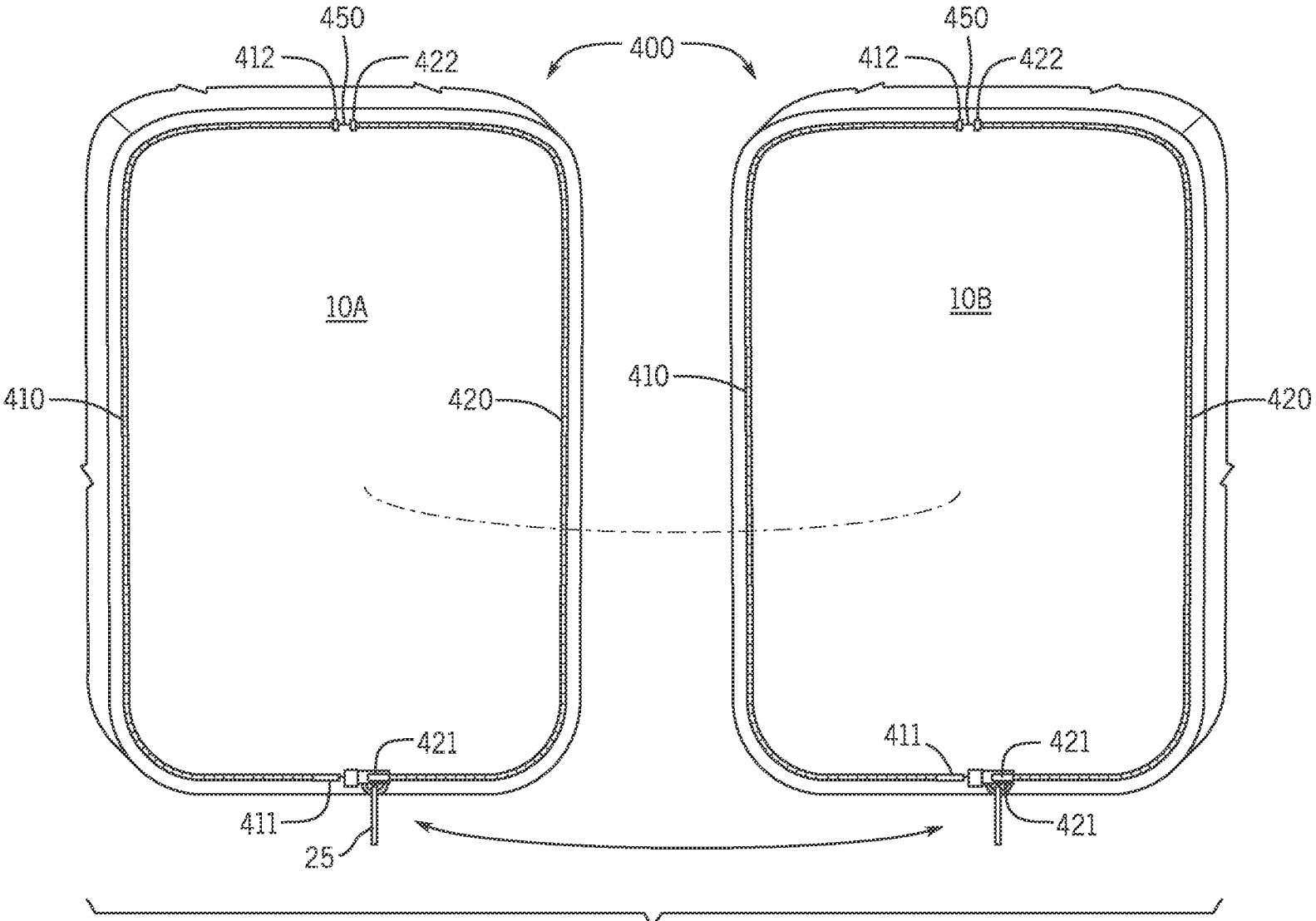
FIG. 22 illustrates the dual zipper system of the configurable bag.

Referring now to FIG. 22, in an embodiment, the configurable bag 1 may have a dual zipper system 400. The dual zipper system 400 may be implemented on a plurality of the individual components 10A and 10B so that any two components 10 may interlock and be secured together. The dual zipper system 400 may have two units 10A, 10B (IE—compartments) each having a first track 410 and a second track 420 located on an end 430 (FIG. 19B) of each component 10. The first track 410 may have a first end 411 and a second end 412. The second track 420 may have a first end 421 and a second end 422. The second end 412 of the first track 410 and the second end 422 of the second track 420 may meet at a termination point 450 wherein the zipper 25 cannot pass over. Preferably, the first track 410 and the second track 420 are substantially of equal length and shape and run substantially along the perimeter of the end 430 of the compartments 10. A single zipper 25 may be located on, for example, only the second track 420 of each compartment 10A, 10B. The first tack 410, the second track 420 and the zipper 25 set-up may thus be generally identical for each compartment 10A, 10B so that the dual zipper track system 400 may interlock any two components 10A, 10B and will have two total zippers 25 connecting two full tracks 410, 420. (The zippers each connect a first track 410 of the first compartment 10A to a second track 420 of the second compartment 10B). The second compartment 10B may be a mirror image of the first compartment 10A so that any two compartments 10 may be connected together and in any orientation, including even upside down.

In an embodiment, a securing mechanism 25 (FIG. 8) may be used to removably connect, for example, a front 220 (FIG. 7) of one compartment 10 with the back 221 of a second compartment 10. The securing mechanism 25 may be, for example, a zipper. The securing mechanism 25 may allow any number of individual compartments 10 to be stacked and secured to each other in a vertical or horizontal orientation.

Figure 23:
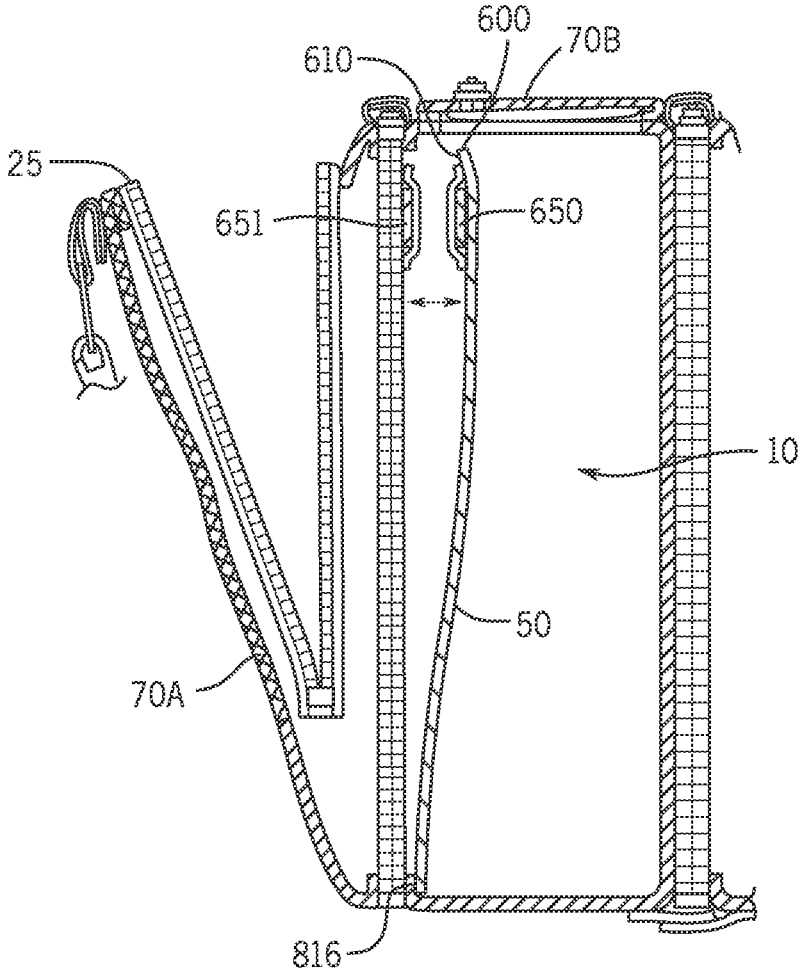
FIG. 23 illustrates a magnetic bib system of the configurable bag in one embodiment.

Finally, referring now to FIG. 23, in an alternative embodiment a magnetic bib 600 may be utilized. The magnetic bib 600 may be the top portion of the lining 50. The magnetic bib 600 may have a top end 610 having a magnet 650 (which is stitched to the magnetic bib 600). The magnet 650 of the magnetic bib 600 may correspondingly be secured to a magnet 651 located within the interior 100 of the compartment 10. More specifically, the magnet 650 of the magnetic bib 600 may allow a user to control the movement of the lining 50 of the compartment 10. An end 816 of the liner 50 may be permanently secured to the interior 100 of the compartment 10 and may allow the liner 50 to pivot within the compartment 10.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages

The invention claimed is:

1. A configurable bag comprising:

a housing having a top, a bottom, a front, a back, a first side, a second side and a generally hollow interior wherein the top, the bottom, the front, the back, the first side and/or the second side has an opening for allowing access into the generally hollow interior of the housing;

a first strap secured to the housing;

a second strap secured to the housing;

a first handle portion located on the first strap wherein the first handle portion has a first unit and a second unit;

a first handle portion on the second strap wherein the first handle portion of the second strap has a first unit only;

a single magnet on the first unit of the first handle portion and a plurality of magnets on the second unit of the first handle portion;

a plurality of magnets on the first unit of the first handle portion of the second strap; and wherein the magnets secure the first unit of the first handle portion of the second strap between the first unit and the second unit of the first handle portion of the first strap when the first handle portion is brought next to and touches the second handle portion.

2. The configurable bag of claim 1 wherein the first unit of the first handle portion of the first strap rotates with respect to the second unit of the first handle portion of the first strap.

3. The configurable bag of claim 2 wherein the magnet of the first unit of the first handle portion is not located on top of and is not magnetically attracted to any of the magnets of the second unit of the first handle portion of the first strap when the first unit is rotated above the second unit of the first handle portion.

4. The configurable bag of claim 2 wherein each of the magnets of the first handle portion of the second strap aligns with and is magnetically attracted to a magnet of the first strap when the first unit of the first strap is folded over with respect to the second unit of the first handle portion of the first strap.

5. The configurable bag of claim 2 wherein a magnetic attraction only occurs when the first handle portion of the second strap is located between the first unit and the second unit of the first strap.

* * * * *